US006769364B2

(12) United States Patent
Kolodzey et al.

(10) Patent No.: US 6,769,364 B2
(45) Date of Patent: Aug. 3, 2004

(54) FULL-CALIBER PROJECTILE

(75) Inventors: Jürgen Kolodzey, Fassberg/Milden (DE); Thomas Heitmann, Unterlüss (DE); Michael Imdahl, Unterlüss (DE); Michael Vagedes, Hermannsburg (DE)

(73) Assignee: Rheinmetall W & M GmbH, Unterluss (DE)

( * ) Notice: Subject to any disclaimer, the term of this patent is extended or adjusted under 35 U.S.C. 154(b) by 0 days.

(21) Appl. No.: 10/303,060

(22) Filed: Nov. 25, 2002

(65) Prior Publication Data

US 2003/0101892 A1 Jun. 5, 2003

(30) Foreign Application Priority Data

Nov. 23, 2001 (DE) ..... 101 57 563

(51) Int. Cl.[7] ..... F42B 14/00
(52) U.S. Cl. ..... 102/527; 102/524; 102/526
(58) Field of Search ..... 102/524, 526, 102/527

(56) References Cited

U.S. PATENT DOCUMENTS

| | | | | | |
|---|---|---|---|---|---|
| 55,761 | A | * | 6/1866 | Broadwell | 102/527 |
| 1,341,844 | A | * | 6/1920 | Dougan | 102/526 |
| 1,861,522 | A | * | 6/1932 | Brandt | 102/526 |
| 2,313,402 | A | * | 3/1943 | Jurechek | 102/527 |
| 2,856,856 | A | * | 10/1958 | Michael | 102/526 |
| 3,460,478 | A | * | 8/1969 | Ormanns | 102/526 |
| 3,687,079 | A | * | 8/1972 | Scollins | 102/526 |
| 3,769,912 | A | | 11/1973 | Friend | |
| 3,939,773 | A | * | 2/1976 | Jenkins et al. | 102/526 |
| 4,532,868 | A | * | 8/1985 | Gleichaut et al. | 102/527 |
| 4,558,646 | A | * | 12/1985 | Hoffmann et al. | 102/527 |
| 4,833,995 | A | * | 5/1989 | Gotz et al. | 102/527 |
| 5,682,011 | A | * | 10/1997 | Sabranski et al. | 102/526 |
| 6,234,082 | B1 | | 5/2001 | Cros et al. | |
| 6,431,076 | B1 | * | 8/2002 | O'Dwyer | 102/526 |

FOREIGN PATENT DOCUMENTS

| | | | | |
|---|---|---|---|---|
| DE | 3544946 | * | 6/1987 | 102/527 |
| DE | 4133617 | * | 4/1993 | 102/526 |
| FR | 1231601 | * | 9/1960 | 102/524 |
| GB | 677 371 A | | 8/1952 | |
| GB | 1 389 950 A | | 4/1975 | |
| JP | 4198697 | * | 7/1992 | 102/526 |

* cited by examiner

*Primary Examiner*—Harvey E. Behrend
(74) *Attorney, Agent, or Firm*—Venable LLP; Stuart I. Smith

(57) ABSTRACT

A full-caliber projectile having a cylindrical guide region (5) and an ogival projectile tip (7). To improve the stabilization of the projectile (1) inside a gun barrel (2) in a simple manner, and therefore improve the intermediate ballistics and hit accuracy over those of comparable projectiles, a guide ring (8), which is segmented in the circumferential direction, and whose outer diameter is smaller than the inner diameter of a gun barrel (2) of the same caliber, is secured to the projectile tip (7) such that the radially spaced guide-ring segments (9) detach from the projectile (1) in the gun barrel (2) when a predetermined firing acceleration occurs in the gun barrel, and the segments (9) are pushed toward the projectile (1), axially relative to the cylindrical guide region (5), by dynamic pressure until they rest against the inside wall (18) of the gun barrel (2) and against the projectile (1).

14 Claims, 3 Drawing Sheets

FULL-CALIBER PROJECTILE

CROSS-REFERENCE TO RELATED APPLICATION

This application is based on and claims the priority date of German Application No. DE 101 57 563.7, filed on Nov. 23, 2001, which is incorporated herein by reference.

BACKGROUND OF THE INVENTION

The invention relates to a full-caliber projectile having a cylindrical guide region and an ogival projectile tip.

Full-caliber tank projectiles, in particular, have too short a guide length (usually, the length of the projectile region that is guided through the gun barrel) because of their relatively long, ogival tip. Consequently, the corresponding projectile is often poorly stabilized inside the gun barrel and therefore has unfavorable intermediate ballistics and a poor dispersion pattern.

U.S. Pat. No. 3,769,912 discloses a spin-stabilized special projectile whose ogival tip is significantly longer than the cylindrical guide region. To increase the guide length, it is proposed in this publication to secure a guide ring to the projectile tip, with the ring being segmented at the circumference and supported against the inside wall of the gun barrel with three shell-like guide-ring segments. As the projectile passes through the barrel, the guide-ring segments remain in their predetermined position at the projectile tip, and then are jettisoned laterally due to the centrifugal forces acting on them after the projectile has exited the barrel.

A drawback of these projectiles is that the guide ring must have a fairly massive design, because it must bridge the entire distance between the projectile and the inside wall of the gun barrel in the region of the projectile tip. Furthermore, the detachment of the guide ring after the projectile has exited the gun barrel presupposes the effect of sufficient centrifugal forces, which are not present with projectiles that are fired from smooth-bore cannons. These known guide rings have failed particularly in conventional full-caliber projectiles having a cylindrical guide region whose length is greater than or equal to the length of the ogival projectile tip.

SUMMARY OF THE INVENTION

It is the object of the invention to provide a full-caliber projectile that is stabilized better inside the gun barrel, in a simple manner, which attains better intermediate ballistics and hit accuracy.

The above object generally is achieved according to the present invention by a full-caliber projectile comprising: a projectile body having a cylindrical guide region and an ogival projectile tip connected to a front end of the guide region; a cylindrical guide ring, which is divided at its circumference into at least two shell-like guide-ring segments, mounted on an outer surface of the projectile tip, with an outer diameter of the ring being smaller than an inner diameter of a gun barrel of the same caliber as the projectile; and means securing the guide ring to the outer surface of the projectile tip such that the guide-ring segments detach from the projectile and move rapidly outwardly when a predetermined firing acceleration is attained in the corresponding gun barrel, so that the guide-ring segments are pushed rearwardly toward the cylindrical guide region of thew projectile in an axial direction until the guide ring segments rest against the inside wall of the gun barrel and against the projectile. Further, particularly advantageous, embodiments of the invention are disclosed.

The invention is essentially based on the concept of securing a guide ring, which is segmented at the circumference, and whose outer diameter is smaller than the inner diameter of the gun barrel, to the projectile tip such that the radially spaced guide-ring segments detach from the projectile when a predetermined firing acceleration occurs in the gun barrel, and the segments are pushed rearwardly toward the projectile, axially relative to the cylindrical guide region, by dynamic pressure until they rest against the inside wall of the gun barrel and against the projectile. The guide ring extends the cylindrical guide region, while virtually eliminating the guide play in this region.

In an advantageous embodiment of the invention, the adjacent guide-ring segments are connected to one another such that they can move outwardly, in the radial direction, when detaching from the projectile tip, but cannot become axially misaligned relative to one another.

This is achieved by providing at least one circumferentially extending tongue-like extension on one of the adjacent guide-ring segments, with the extension extending, with a form-fit, into a circumferentially divided recess of the adjacent guide-ring segment. It is preferably provided that one end of each guide-ring segment has such a tongue-like extension, while the other end is provided with a recess that is adapted to the tongue-like extension of the adjacent guide-ring segment.

To assure the detachment of the guide ring outside of the gun barrel, even with projectiles fired from smooth-bore cannons, the guide ring should preferably have an air pocket formed on its end surface that faces the projectile tip.

To secure the guide ring to the projectile, it has proven advantageous for the guide ring to have radially extending fastening elements that extend radially inwardly and are provided with break-away or weakened points. The fastening elements extend in a non-positive lockup into corresponding radially extending grooves on the surface of the projectile. As an alternative, the guide ring can be glued or welded to the projectile, or connected to it with the aid of encircling holding bands on the outer circumferential surface of the guide ring.

Further details about and advantages of the invention ensue from the exemplary embodiments described below and illustrated in the figures.

DESCRIPTION OF THE PREFERRED EMBODIMENTS

Figure 1:
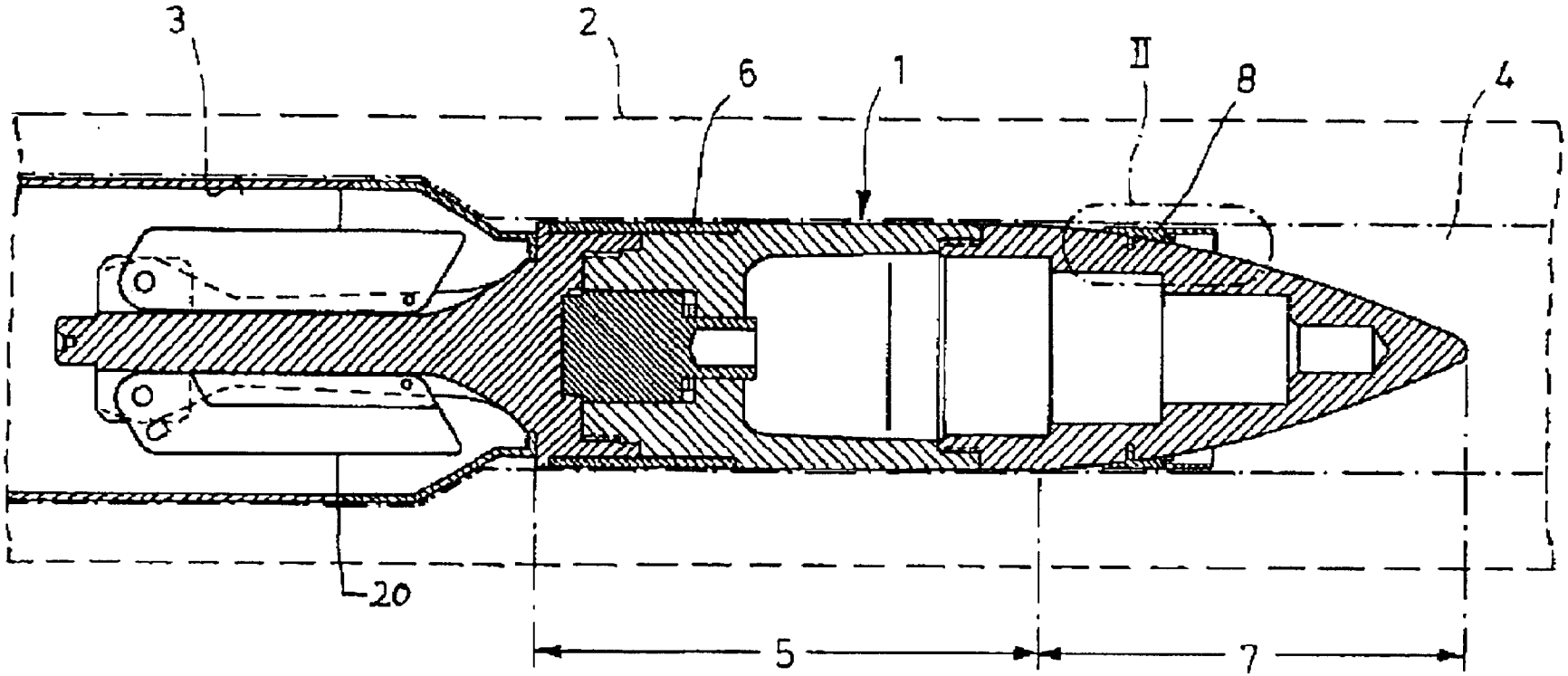
FIG. 1 is a longitudinal section of a fin-stabilized projectile with a guide ring according to the invention secured to the projectile tip.

FIG. 1 depicts a full-caliber, fin-stabilized projectile, with folded fins 20, that is located in a gun barrel 2 indicated in dashed lines. The chamber and the caliber barrel are represented by 3 and 4, respectively.

The projectile 1 has a cylindrical guide region 5 that is provided with a sealing band 6 on its rear side, and an ogival projectile tip 7 at its front.

Figure 2:
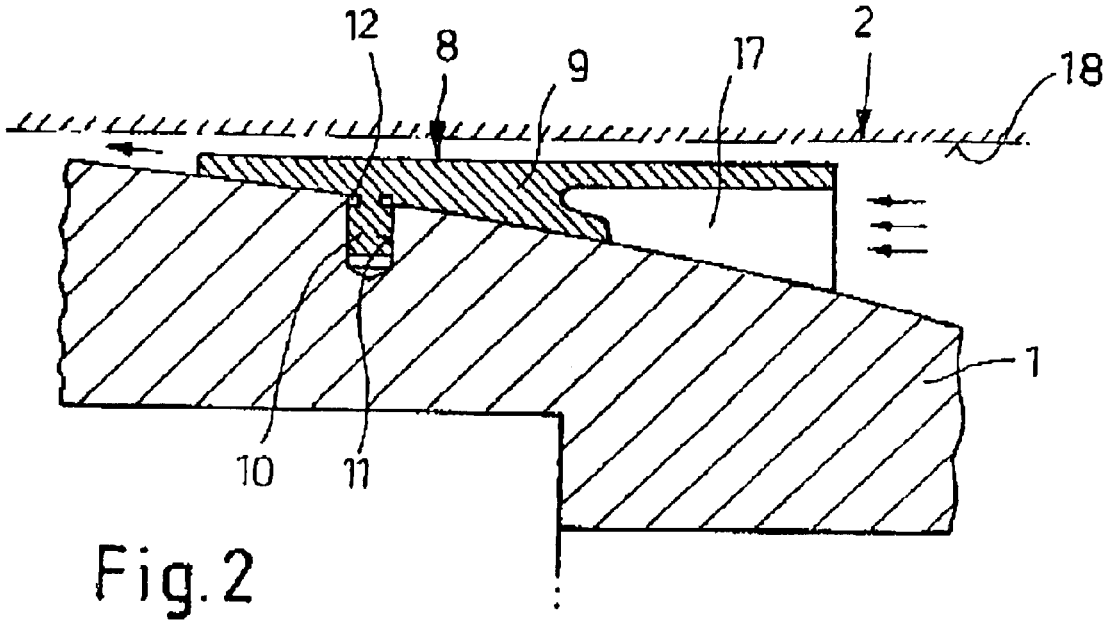
FIG. 2 is an enlarged representation of the region indicated by II in FIG. 1.

According to the invention, a generally cylindrical guide ring 8 is secured to the outer circumferential surface of the projectile tip 7, with the ring 8 being segmented in a known manner at the circumference and formed of a deformable plastic, and including at least two and preferably three shell-like guide-ring segments 9 (see FIG. 2). The outer diameter of the ring 8 is smaller than the inner diameter of the gun barrel 2. The guide ring 8 is secured to the projectile 1 by a plurality of fastening elements 10 (FIG. 2) that preferably are distributed uniformly over the inner circumference of the ring 8 and extend radially inwardly. These elements 10 extend (latch) into corresponding grooves or recesses 11 formed in the outer circumferential surface of the tip 7 of the projectile 1 in a non-positive lockup. The fastening elements 10 are provided with break-away or weakened points 12 which break or rupture when a predetermined force caused by acceleration of the projectile is achieved.

Figure 3:
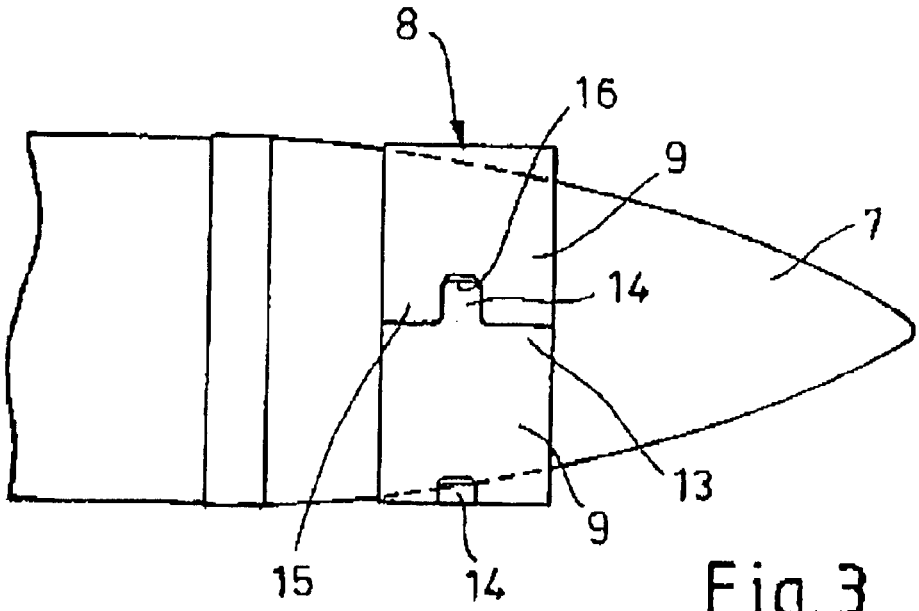
FIG. 3 is a side view of the tip of the projectile shown in FIG. 1.

For each guide-ring segment 9, one end 13, seen in the direction of the circumference, is provided with a tongue-like extension 14 extending in the circumferential direction, and the other end 15 is provided with a recess or groove 16 (FIG. 3) that is adapted to the tongue-like extension 14 of the adjacent guide-ring segment 9. The lengths of the extensions 14 and grooves 16 are such that upon radial displacement of the segments 9 following rupture of the break points 12, the extensions 14 cannot come out the respective grooves 16 as long as the guide ring 8 is still inside the barrel 2. This prevents axial misalignment of the segments 9.

The guide ring 8 has an air pocket 17 (FIG. 2) formed in a conventional manner in its end surface facing the tip of the ogival projectile tip 7.

The function of the invention is described in detail below:

After the corresponding cartridge has been ignited, the projectile 1 in the caliber barrel 4 is set in motion. When the firing acceleration reaches a predetermined value, the pressure produced in the air-pocket 17 causes the break-away points 12 to rupture. As the projectile 1 continues to pass through the barrel, the guide-ring segments 9 are displaced radially outwardly and axially rearwardly toward the back relative to the projectile, and in particular the cylindrical caliber guide portion 5, and are clamped between the circumferential surface of the projectile 1 and the inside wall 18 of the gun barrel 2. This virtually eliminates the guide play, and extends the guide length of the projectile 1 by the axial length of the guide ring 8.

The fact that the tongue-like extensions 14 still extend into the recesses 16 of the adjacent guide-ring segments 9 prevents an axial misalignment of the guide-ring segments 9.

As soon as the projectile 1 has left the muzzle of the gun barrel 2, the guide-ring segments 9 are pressed away to the side from the projectile 1 by the dynamic pressure or the air forces in the air pocket 12.

Of course, the invention is not limited to the above-described embodiments. For example, the guide ring 8 need not comprise a deformable plastic. It is also possible to use a different deformable material, such as lead, brass or copper. A disadvantage of these materials, however, is their high densities. Thus, they increase the dead-weight component to be accelerated, as well as the stress caused by axial forces on the parts to be carried. Plastic is preferred because of its low density and low production costs (injection-molding technique). Moreover, the guide ring may be fastened to the projectile by welding (e.g., spot welding, or gluing), instead of the fastening elements 10 and grooves 11, so long as they are structured to rupture at the predetermined acceleration. Additionally, the segments 9 of the guide ring 8 may be fastened to the projectile in a known manner by a holding band that is disposed on the outer circumferential surface of the ring segments 9.

Figure 4:
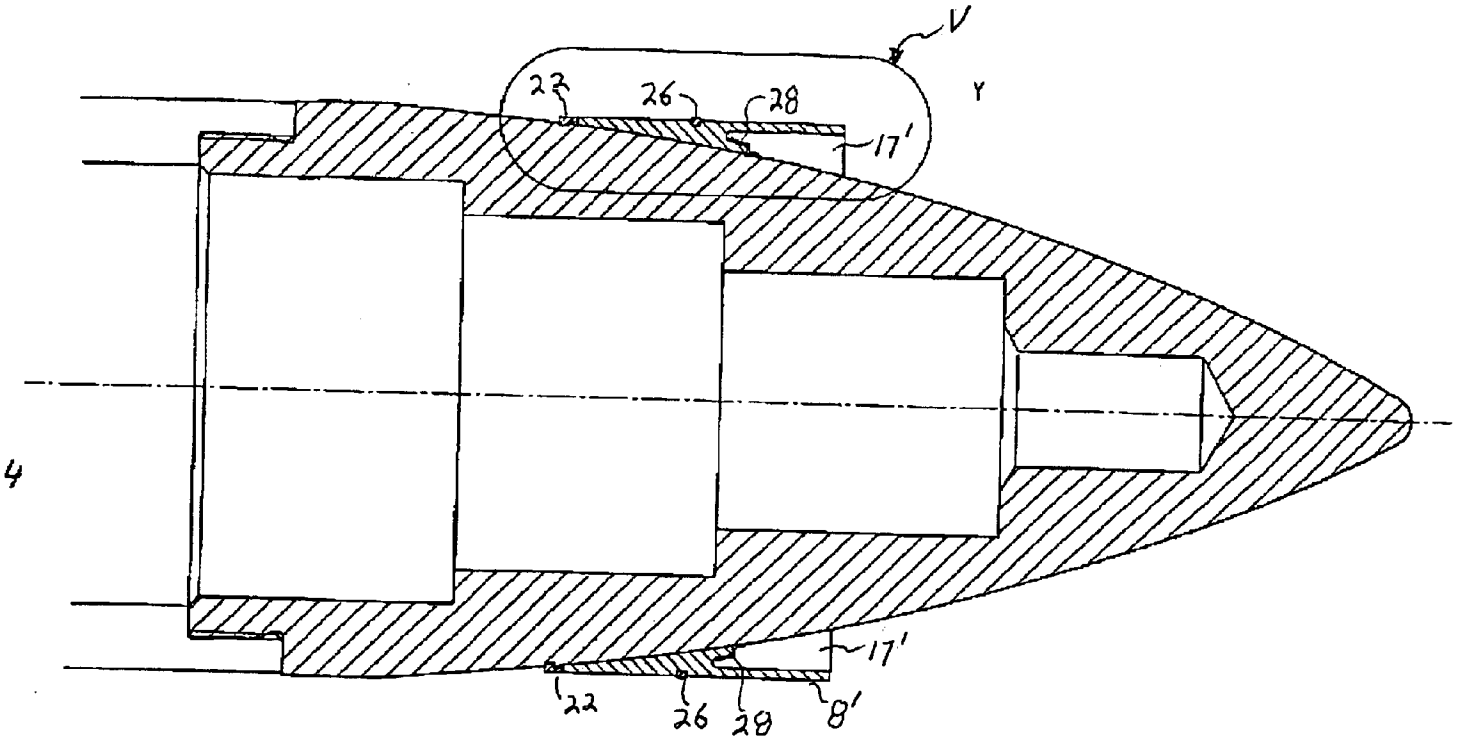
FIG. 4 is a longitudinal section of a projectile with a guide ring according to the invention but with for securing the guide ring to the projectile.

FIG. 4 shows a further embodiment of a projectile tip similar to that shown in FIG. 1 with a guide ring 8' disposed thereon, but fastened to the projectile in a manner different than that shown in FIGS. 1 and 2. All other features of the guide ring 8' can be identical to that shown in FIGS. 1–3 and described above. An enlarged version of the alternative manner of connecting the guide ring 8' to the projectile is shown in FIG. 5.

Figure 5:
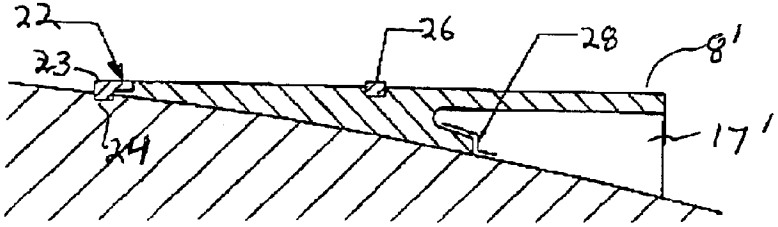
FIG. 5 is an enlarged representation of the region indicated by V in FIG. 4.

According to the embodiment of FIG. 5, in place of the projections and grooves 10 and 11 of FIGS. 1 and 2, the guide ring 8' can be held in place on the projectile by a continuous band 22, or a band formed by a plurality of spaced members distributed about the periphery of the projectile, that in general is L-shaped having one arm extending forwardly over a rear end or trailing edge of the guide ring 8'. The other arm of the member 22 extends into a groove in the cicumferential surface of the projectile in a non-locking manner.

Alternatively, the segments of the guide ring 8' may be held in place by a holding band 26 which extends around the entire outer circumference of the guide ring 8'. With the use of the holding band 26, an axial displacement of the guide ring 8' prior to the desired time is prevented either through friction, a weak adhesive, or another holding device, for example, the holding device 22.

Finally, an adhesive tape 28 disposed within the air pocket 17' and connected between the surface of the projectile and a portion of the guide ring 8' at the bottom of the air pocket 17', i.e., the leading edge may be utilized. It should be noted, that the three general holding band arrangements 22, 26 and 28 shown in FIGS. 4 and 5 can be used individually and/or in any combination, as desired. Moreover, the positions of, for example, the bands 22 and 26 may be interchanged and/or reversed. That is, the band or element 22 may be placed, mirror inverted, at the illustrated location of the adhesive band 28, and vise versa. In each case, regardless of whether one or all of these bands are utilized, they tend to hold the guide ring 8' in place on the circumference of the projectile until the guide ring 8' is caused to expand radially as a result of air pressure in the air pocket 17'.

The invention now being fully described, it will be apparent to one of ordinary skill in the art that many changes and modifications can be made thereto without departing from the spirit or scope of the invention as set forth herein.

What is claimed is:

1. A full-caliber projectile comprising:

a projectile body having a cylindrical guide region and an ogival projectile tip, connected to a front end of the guide region;

a cylindrical guide ring, which is divided at its circumference into at least two shell-like guide-ring segments, mounted on an outer surface of the projectile tip, with an outer diameter of the ring being smaller than an inner diameter of a gun barrel of the same caliber as the projectile; and means securing the guide ring to the outer surface of the projectile tip such that the guide-ring segments detach from the projectile and move rapidly outwardly when a predetermined firing acceleration is attained in the corresponding gun barrel, so that the guide-ring segments are pushed rearwardly toward the cylindrical guide region of the projectile in an axial direction until the guide ring segments rest against the inside wall of the gun barrel and against the projectile.

2. The projectile according to claim 1, further comprising means connecting adjacent of said guide-ring segments to one another such that the segments can move radially outwardly after detaching from the projectile tip, but do not become axially misaligned due to the radial displacement.

3. The projectile according to claim 2, wherein the means for connecting adjacent ones of said guide rings to one another comprises at least one tongue-like extension that extends in the direction of the circumference formed on one of the adjacent guide-ring segments and extending, in a form-fit, into a recess that extends in the circumferential direction of the adjacent guide-ring segment.

4. The projectile according to claim 3, wherein, one end, seen in the direction of the circumference, of each guide-ring segment is provided with at least one of said tongue-like extensions, and the other end is provided with at least one of said recess that is adapted to the tongue-like extension of the adjacent guide-ring segment.

5. The projectile according to claim 3, wherein the length of each said tongue-like extension and corresponding recess is such that the extension cannot leave the recess while the guide ring is in the gun barrel.

6. The projectile according to claim 1 further comprising an air pocket formed in the front end surface of the guide ring that faces the projectile tip.

7. The projectile according to claim 1 wherein the guide ring comprises a deformable material.

8. The projectile according to claim 7, wherein the guide ring is formed of a deformable plastic.

9. The projectile according to claim 1, wherein the means for securing the guide ring to the projectile includes fastening elements disposed on the guide ring and extending radially inwardly and, in a non-positive lockup, into corresponding radial grooves formed in the circumferential surface of the projectile.

10. The projectile according to claim 9, wherein the fastening elements have break-away points that rupture when said predetermined acceleration is achieved.

11. The projectile according to claim 1, wherein the guide ring is at least one of glued to the projectile, welded to the projectile, and connected to the projectile with the aid of at least one holding band encircling the guide ring.

12. The projectile according to claim 11, wherein the guide ring is connected to the projectile by at least a holding band encircling the outer circumferential surface of the guide ring.

13. The projectile according to claim 11, wherein the guide ring is connected to the projectile by at least a holding band formed of an adhesive tape engaging one of a leading edge and a trailing edge of the guide ring and the outer circumferential surface of the projectile.

14. The projectile according to claim 11, wherein the guide ring is connected to the projectile by at least a holding band with an L-shape having one arm engaged in a recess in the circumferential surface of the projectile and its other arm engaging and overlying one of a leading edge and a trailing edge of the guide ring at the surface of the projectile.

* * * * *